US012690644B2

(12) United States Patent
Bishop et al.

(10) Patent No.: US 12,690,644 B2
(45) Date of Patent: Jul. 28, 2026

(54) AUTOMATIC PUMP FOR ARTICLE OF FOOTWEAR

(71) Applicant: NIKE, Inc., Beaverton, OR (US)

(72) Inventors: Jennifer L. Bishop, Portland, OR (US); Timothy P. Hopkins, Tustin, CA (US); Nicholas R. Long, Portland, OR (US); Nadia M. Panian, Beaverton, OR (US); Aaron K. Seid, Portland, OR (US); Richard Kristian Hansen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 27 days.

(21) Appl. No.: 18/484,330

(22) Filed: Oct. 10, 2023

(65) Prior Publication Data

US 2024/0115001 A1 Apr. 11, 2024

Related U.S. Application Data

(60) Provisional application No. 63/415,021, filed on Oct. 11, 2022.

(51) Int. Cl.
*A43B 13/20* (2006.01)
*A43B 23/02* (2006.01)

(52) U.S. Cl.
CPC ..... *A43B 13/203* (2013.01); *A43B 23/029* (2013.01)

(58) Field of Classification Search
CPC ..... A43B 7/083; A43B 13/203; A43B 13/206; A43B 23/029
See application file for complete search history.

(56) References Cited

U.S. PATENT DOCUMENTS

| | | | |
|---|---|---|---|
| 4,991,317 | A | 2/1991 | Lakic |
| 5,392,534 | A | 2/1995 | Grim |
| 5,572,917 | A | 11/1996 | Truemner et al. |
| 5,933,983 | A | 8/1999 | Jeon |
| 5,937,545 | A | 8/1999 | Dyer et al. |
| 5,974,695 | A | 11/1999 | Slepian et al. |
| 6,014,823 | A | 1/2000 | Lakic |
| 6,665,958 | B2 | 12/2003 | Goodwin |
| 6,944,973 | B2 | 9/2005 | Goodwin |
| 7,013,585 | B2 | 3/2006 | Lo |
| 8,015,730 | B2 | 9/2011 | Hazenberg |
| 8,087,187 | B2 | 1/2012 | Aveni et al. |

(Continued)

FOREIGN PATENT DOCUMENTS

WO WO-2021080970 A1 4/2021

OTHER PUBLICATIONS

European Patent Office (ISA), International Search Report and Written Opinion for PCT App. No. PCT/US2023/076520, mailed Jan. 26, 2024.

*Primary Examiner* — Sharon M Prange
(74) *Attorney, Agent, or Firm* — Honigman LLP; Matthew H. Szalach

(57) ABSTRACT

An article of footwear includes an upper including a chamber, a compressible component disposed within the chamber and operable between a relaxed state and a constricted state, a sole structure including a recess forming a cavity, and a pump device disposed within the cavity and fluidly coupled to the chamber, the pump device operable to transition the compressible component from the relaxed state to the constricted state by removing fluid from the chamber.

19 Claims, 11 Drawing Sheets

(56) References Cited

U.S. PATENT DOCUMENTS

| | | | | |
|---|---|---|---|---|
| 9,179,733 | B2 | 11/2015 | Peyton et al. | |
| 2008/0163512 | A1* | 7/2008 | Hazenberg | A43B 21/285 36/28 |
| 2008/0229623 | A1* | 9/2008 | Ferretti | A43B 7/082 36/3 R |
| 2008/0263899 | A1* | 10/2008 | Lee | A43B 7/082 36/35 B |
| 2009/0064536 | A1* | 3/2009 | Klassen | A43B 7/32 36/35 R |
| 2016/0249706 | A1* | 9/2016 | Leary | A43B 23/22 36/93 |
| 2016/0309834 | A1* | 10/2016 | Zwick | A43B 23/021 |
| 2017/0360155 | A1* | 12/2017 | Leary | A43B 23/081 |
| 2018/0110286 | A1* | 4/2018 | Vuong | A43B 13/206 |
| 2019/0000186 | A1* | 1/2019 | Mou | F04B 45/047 |
| 2019/0000188 | A1* | 1/2019 | Mou | F04B 45/027 |
| 2020/0375319 | A1* | 12/2020 | Yang | A43C 11/008 |
| 2021/0120915 | A1* | 4/2021 | Panian | A43B 23/029 |
| 2021/0169177 | A1* | 6/2021 | Yang | A43C 11/00 |
| 2021/0244128 | A1* | 8/2021 | Costa | A43B 3/0036 |
| 2022/0104582 | A1* | 4/2022 | Christensen | A43B 13/203 |

* cited by examiner

AUTOMATIC PUMP FOR ARTICLE OF FOOTWEAR

CROSS REFERENCE TO RELATED APPLICATIONS

This application claims priority under 35 U.S.C. § 119(e) to U.S. Provisional Application No. 63/415,021, filed on Oct. 11, 2022. The disclosure of this prior application is considered part of the disclosure of this application and is hereby incorporated by reference in its entirety.

FIELD

The present disclosure relates generally to an article of footwear, and more particularly to a sole structure for an article of footwear

BACKGROUND

This section provides background information related to the present disclosure and is not necessarily prior art.

Articles of apparel, such as garments and headwear, and articles of footwear, such as shoes and boots, typically include a receptacle for receiving a body part of a wearer. For example, an article of footwear may include an upper and a sole structure that cooperate to form a receptacle for receiving a foot of a wearer. Likewise, garments and headwear may include one or more pieces of material formed into a receptacle for receiving a torso or head of a wearer.

Articles of apparel or footwear are typically adjustable and/or include a relatively flexible material to allow the article of apparel or footwear to accommodate various sizes of wearers, or to provide different fits on a single wearer. While conventional articles of apparel and articles of footwear are adjustable, such articles typically require a wearer to secure the article by lacing or other means. For example, while laces adequately secure an article of footwear to a wearer by contracting or constricting a portion of an upper around the wearer's foot, the laces do not cause the upper to lock in a size or shape conforming to the user's foot. Accordingly, an optimum fit of the upper around the foot is difficult to achieve.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1A:
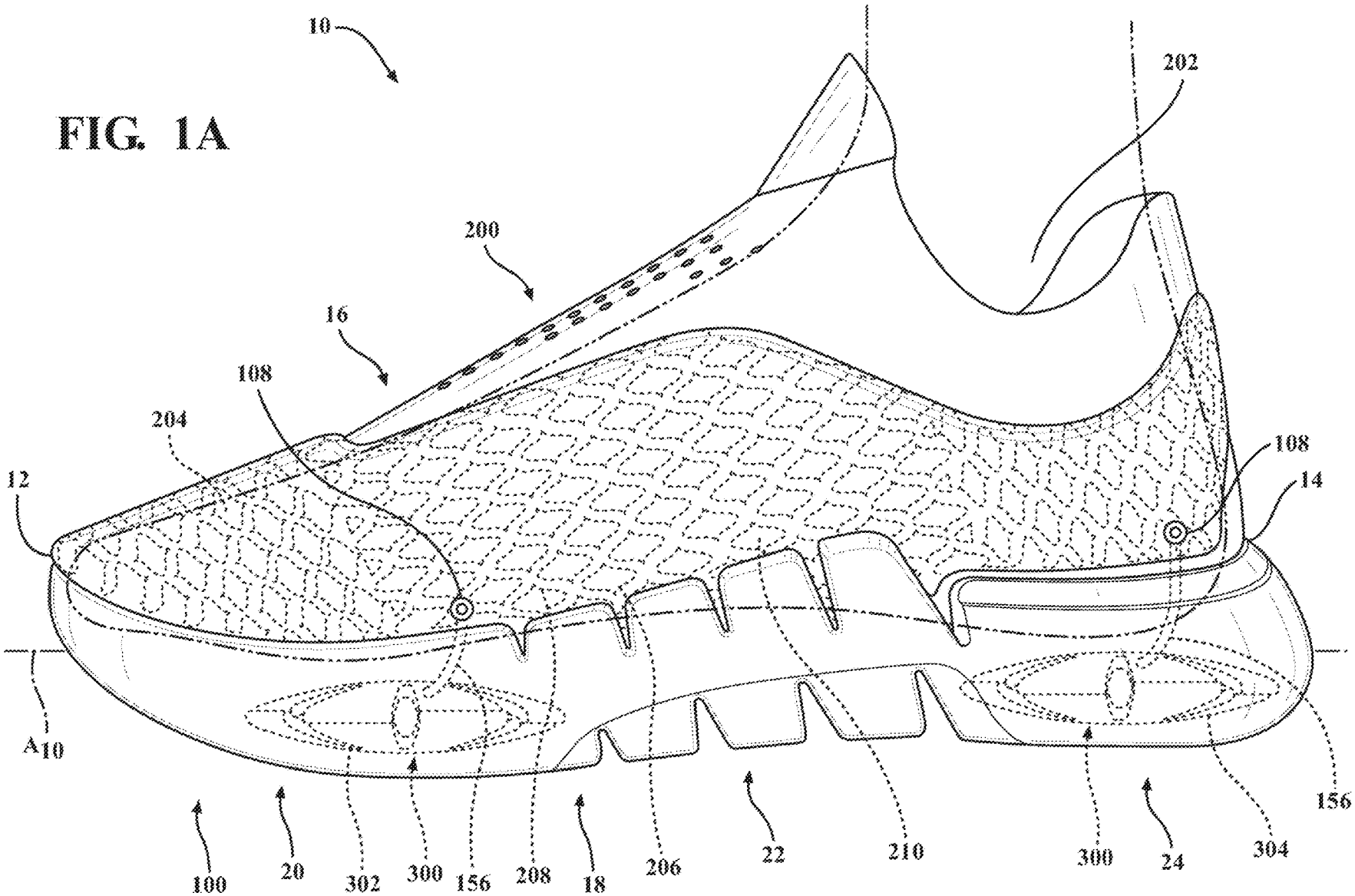
FIG. 1A is a lateral side perspective view of an article of footwear incorporating an automatic pump according to an example of the present disclosure, where the article of footwear is in a relaxed state.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an article of footwear includes an upper including a chamber, a compressible component disposed within the chamber and operable between a relaxed state and a constricted state, a sole structure including a recess forming a cavity, and a pump device disposed within the cavity and fluidly coupled to the chamber, the pump device operable to transition the compressible component from the relaxed state to the constricted state by removing fluid from the chamber.

The article of footwear may include one or more of the following optional features. For example, the pump device may include a fluid envelope disposed between a first plate and a second plate. The pump device may include a valve in fluid communication with the chamber and the fluid envelope. Optionally, the valve may be operable to restrict movement of fluid from the fluid envelope to the chamber. In one configuration, the fluid removed from the chamber may be received within the fluid envelope. In one example, at least one of the first plate and the second plate may be formed from a resilient material. The first plate and the second plate may be biased in a direction away from one another and into an expanded state. Additionally or alternatively, the first plate and the second plate may be moved toward one another when moved from the expanded state to a compressed state. Fluid may be drawn from the chamber and into the fluid envelope when the first plate and the second plate are moved from the compressed state to the expanded state. Optionally, a release may be operable to selectively allow fluid to enter the chamber and permit movement of the compressible component from the constricted state to the relaxed state.

In another configuration, an article of footwear includes a chamber, a sole structure, and a pump device disposed within the sole structure and including a first plate, a second plate, and a fluid envelope disposed between the first plate and the second plate and fluidly coupled to the chamber, the pump device operable to selectively remove fluid from the chamber when the first plate and the second plate are moved away from one another and into an expanded state.

The article of footwear may include one or more of the following optional features. For example, the pump device may be disposed within the sole structure. The pump device may include a valve in fluid communication with the chamber and the fluid envelope. Optionally, the valve may be operable to restrict movement of fluid from the fluid envelope into the chamber. In one configuration, fluid removed from the chamber may be received within the fluid envelope. In another example, at least one of the first plate and the second plate may be formed from a resilient material. The first plate and the second plate may be biased into the expanded state. Additionally or alternatively, the first plate and the second plate may be moved toward one another when moved from the expanded state to a compressed state. Optionally, the fluid envelope may be formed from a first barrier element and a second barrier element, the first barrier element being attached to the first plate and the second barrier element being attached to the second plate. In another configuration, a release may be operable to selectively allow fluid to enter the chamber.

The details of one or more implementations of the disclosure are set forth in the accompanying drawings and the description below. Other aspects, features, and advantages will be apparent from the description, the drawings, and the claims.

Figure 1B:
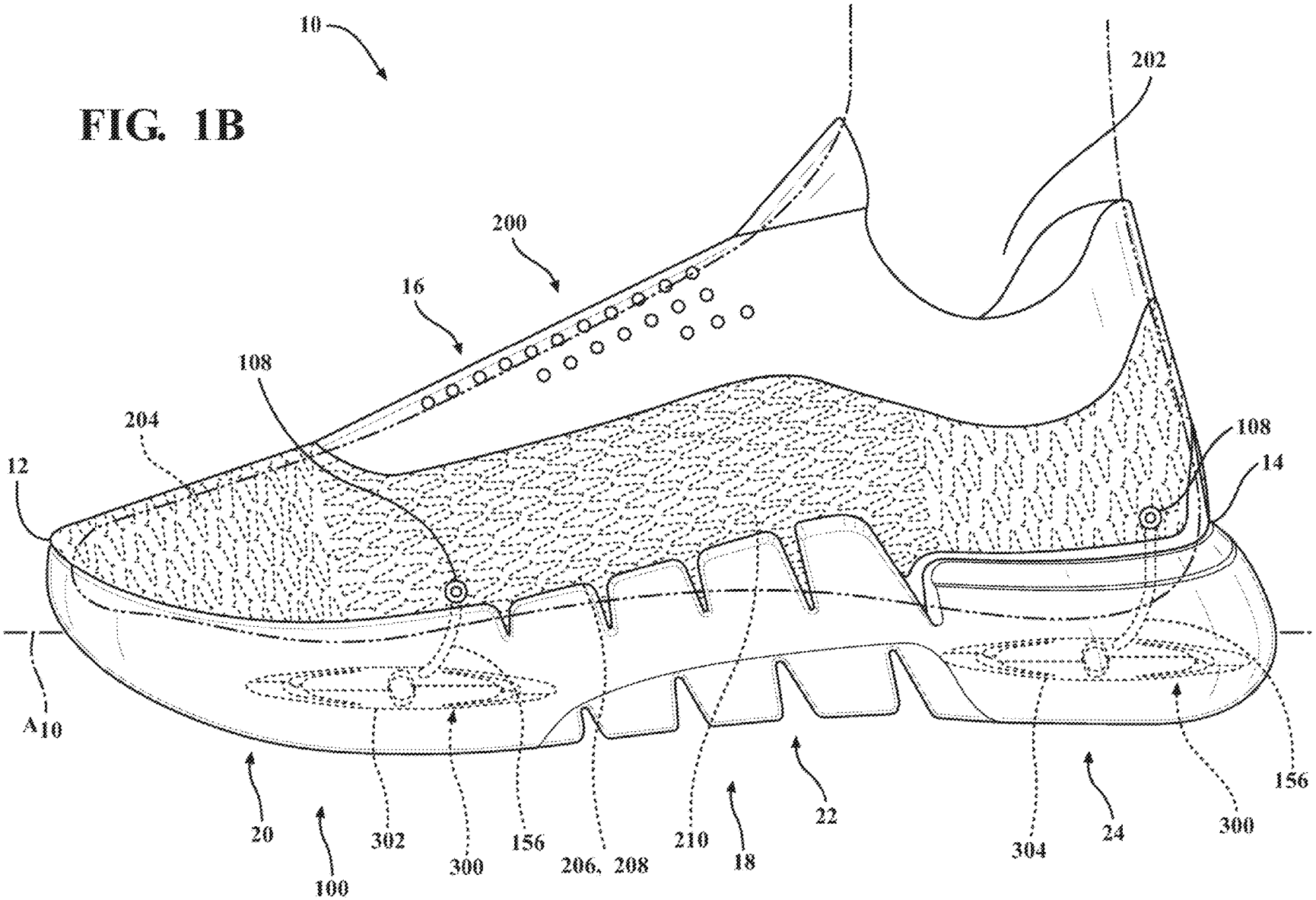
FIG. 1B is a lateral side perspective view of the article of footwear of FIG. 1A, where the article of footwear is in a constricted state.
Figure 2:
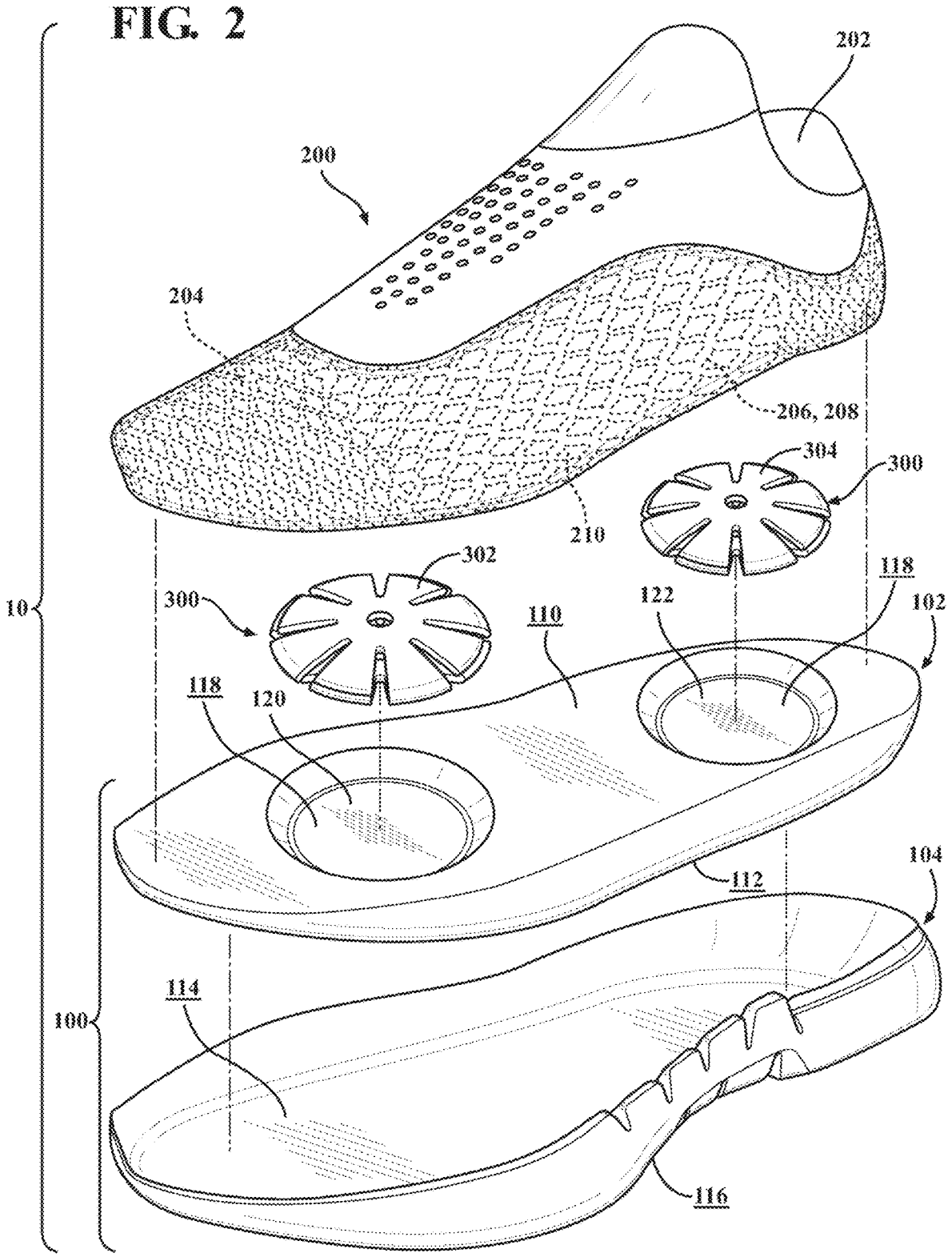
FIG. 2 is a top-front exploded perspective view of the article of footwear of FIG. 1A.

Referring to FIGS. 1A-2, an article of footwear 10 includes a sole structure 100 and an upper 200 attached to the sole structure 100. The article of footwear 10 may further include an anterior end 12 associated with a forward-most point of the footwear, and a posterior end 14 corresponding to a rearward-most point of the footwear 10. A longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may correspond with the phalanges and the metatarsal bones of a foot. The mid-foot region 22 may correspond with an arch area of the foot, and the heel region 24 may correspond with rear portions of the foot, including a calcaneus bone.

As shown, the sole structure 100 includes a midsole 102 configured to provide cushioning and support and an outsole 104 defining a ground-engaging surface of the sole structure 100. In other examples, the midsole 102 may be configured as a composite structure including a plurality of components joined together.

The article of footwear 10 may be further described as including an automatic pump device 300 and a release feature 108. The automatic pump device 300 is disposed in the sole structure 100 and may be in fluid communication with the upper 200 through one or more valves to adjust the pressure in the upper 200 from a first pressure (e.g., at or above ambient) to a second pressure (e.g., at or below ambient) by removing fluid (e.g., a gas or liquid) from the upper 200. As illustrated, the automatic pump device 300 may include a first pump 302 disposed in the forefoot region 20 of the midsole 102, and a second pump 304 disposed in the heel region 24 of the midsole 102. However, in some implementations, the automatic pump device 300 may include a single pump 300 disposed in the forefoot region 20, the mid-foot region 22, or the heel region 24 or any combination of pumps 300 located in the forefoot region 20, the mid-foot region 22, and/or the heel region 24. The release feature 108 may be connected to an outside surface of the upper 200 and is in fluid communication with the automatic pump device 300 through one or more valves. As discussed in greater detail below, the automatic pump device 300, and the release feature 108 cooperate to transition the upper 200 between a constricted state (FIG. 1B) and a relaxed state (FIG. 1A).

With reference to FIG. 2, the midsole 102 is further defined by a top surface 110 facing the upper 200, and a bottom surface 112 formed on an opposite side of the midsole 102 than the top surface 110 and facing away from the upper 200. Stitching and/or adhesives may secure the midsole 102 to the upper 200. The top surface 110 of the midsole 102 includes a foot cavity that defines a footbed of the sole structure 100 extending continuously from the anterior end 12 to the posterior end 14 of the footwear 10. The outsole 104 is defined by a top surface 114 facing the bottom surface 112 of the midsole 102, and a bottom surface 116 that defines a ground-engaging surface and is formed on an opposite side of the outsole 104 than the top surface 114.

The midsole 102 and the outsole 104 include a resilient polymeric material, such as foam or rubber, to impart properties of cushioning, responsiveness, and energy distribution to the foot of the wearer. In the illustrated example, the midsole 102 is formed of a first foam material, and the outsole 104 is formed of a second foam material. For example, the midsole 102 may include foam materials providing greater cushioning and impact distribution, while the outsole 104 includes a foam material having a greater stiffness and/or rigidity in order to provide increased lateral stiffness to the sole structure 100.

Example resilient polymeric materials for the midsole 102 and the outsole 104 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

As shown, a recessed surface 118 is offset from the top surface 110 of the midsole 102 to form a first cavity 120 and a second cavity 122 and in the top surface 110 of the midsole 102. The second cavity 122 may be spaced apart from the first cavity 120. The first cavity 120 may be sized to receive a first pump 302 of the automatic pump device 300, while the cavity 122 may be sized to receive a second pump 304 of the automatic pump device 300. In other words, the first cavity 120 and the second cavity 122 cooperate to receive the automatic pump device 300 including the first pump 302 and the second pump 304. Optionally, the first pump 302 and the second pump 304 may be configured to operate in series to maximize the evacuation of the upper 200. Alternatively, the first pump 302 and the second pump 304 may be coupled in parallel to maximize the total volume of fluid drawn by the pump device 300. While FIG. 2 shows the first cavity 120 and the second cavity 122 disposed in the forefoot region 20 and the heel region 24, respectively, the first cavity 120 and the second cavity 122 may alternatively be disposed in any of the forefoot region 20, the mid-foot region 22, or the heel region 24 of the midsole 102. In some implementations, the midsole 102 and the outsole 104 are integrally formed and receive the automatic pump device 300. Alternatively, the automatic pump device 300 may extend to an outer surface of the article of footwear (not shown) to allow access to the automatic pump device 300.

Referring again to FIGS. 1A-2, the upper 200 may be formed from one or more materials that are stitched or adhesively bonded together to define the interior void 202. Suitable materials of the upper 200 may include, but are not limited to, textiles, foam, leather, and synthetic leather. The example upper 200 may be formed from a combination of one or more substantially inelastic or non-stretchable materials and one or more substantially elastic or stretchable materials disposed in different regions of the upper 200 to facilitate movement of the article of footwear 10 between the constricted state and the relaxed state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

In the illustrated example, the upper 200 includes one or more fluid chambers 204 in fluid communication with the pump device 300. Each of the chambers 204 includes a compressible component 206 disposed therein, which compresses as the upper 200 transitions from the relaxed state (FIG. 1A) to the constricted state (FIG. 1B). The compressible component 206 may include a lattice structure 208 defining a plurality of reliefs 210 (e.g., openings). As discussed above with reference to FIGS. 1A and 1B, the automatic pump device 300 is in fluid communication with the chambers 204 of the upper 200. In these implementations, an intake conduit 156 connects the automatic pump device 300 to the chambers 204 of the upper 200 allowing fluid communication between the automatic pump device 300 and the upper 200. Stated differently, the pump device 300 may be fluidly coupled to the chambers 204 to transition the compressible component 206 between the relaxed state and the constricted state.

With reference to FIGS. 3A-6B, the automatic pump device 300 is illustrated in multiple configurations. In view of the substantial similarity in structure and function of the components associated with the automatic pump device 300, like reference numerals are used hereinafter and in the drawings to identify like components while like reference numerals containing letter extensions are used to identify those components that have been modified.

Figure 3A:
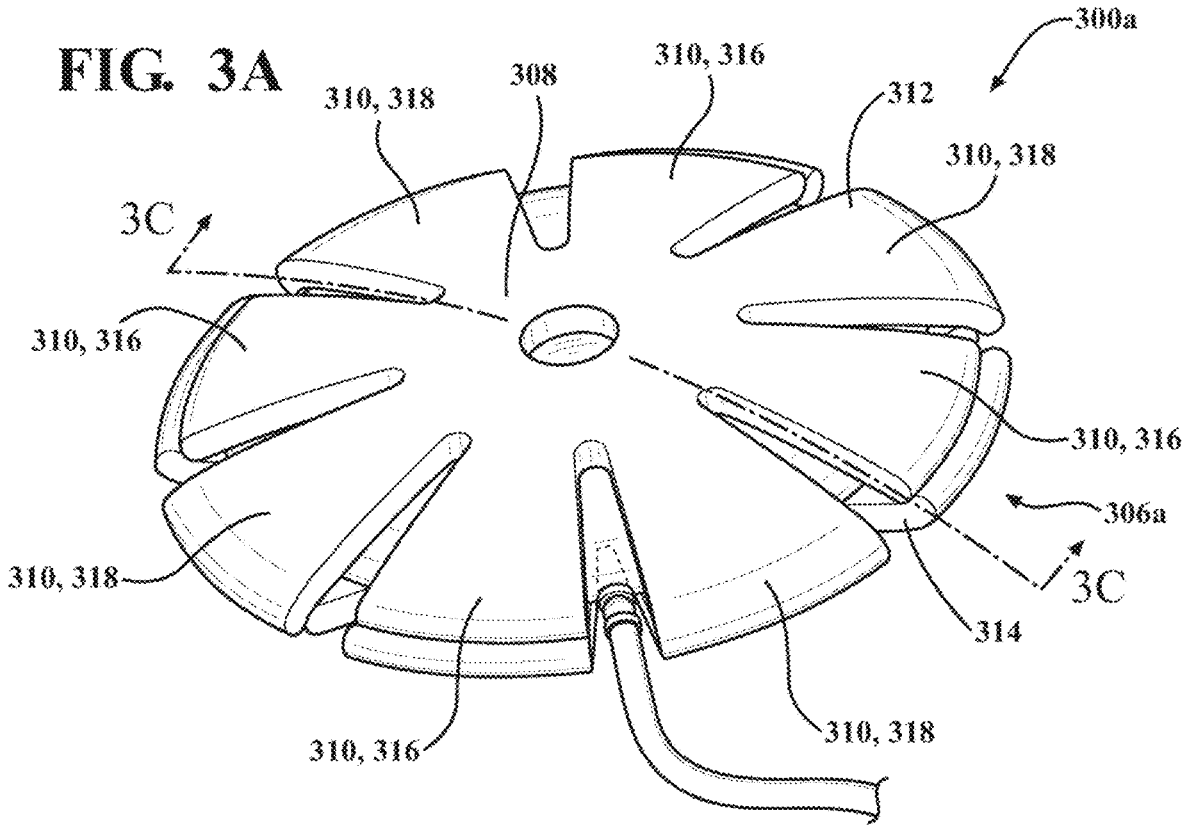
FIG. 3A is a perspective view of a pump device according to an example of the present disclosure with a first plate and a second plate disposed around a fluid envelope.
Figure 3B:
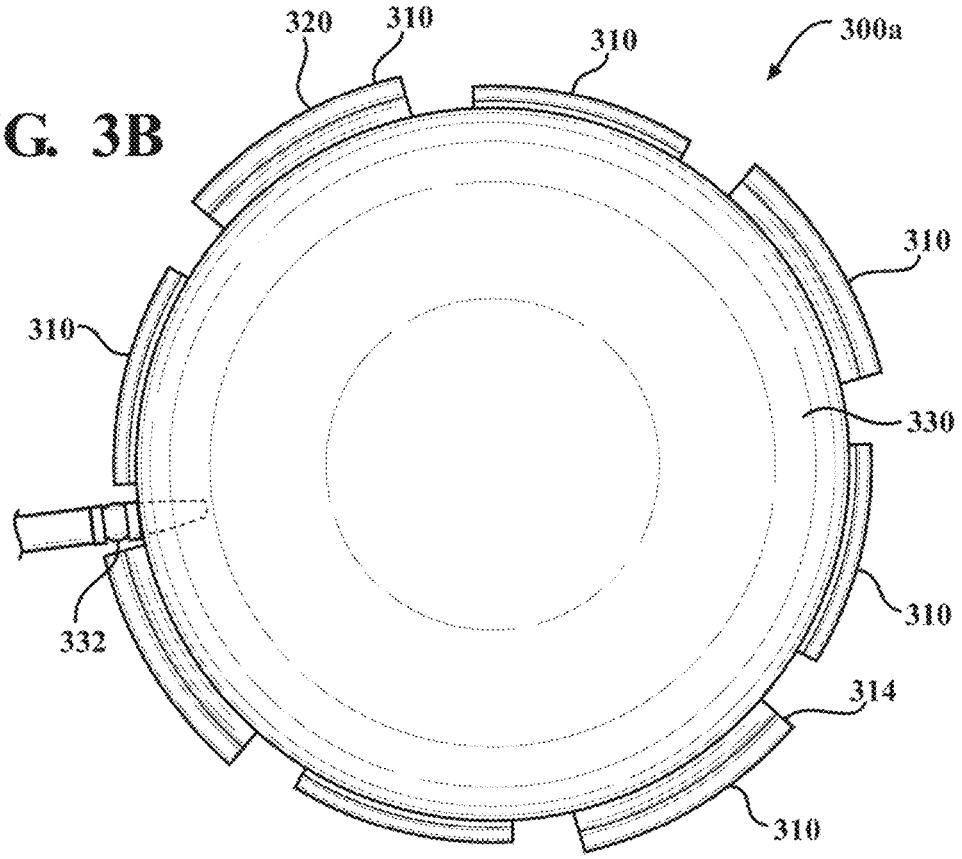
FIG. 3B is a top view of the pump device of FIG. 3A with part of a housing removed to show a fluid envelope.
Figure 3C:
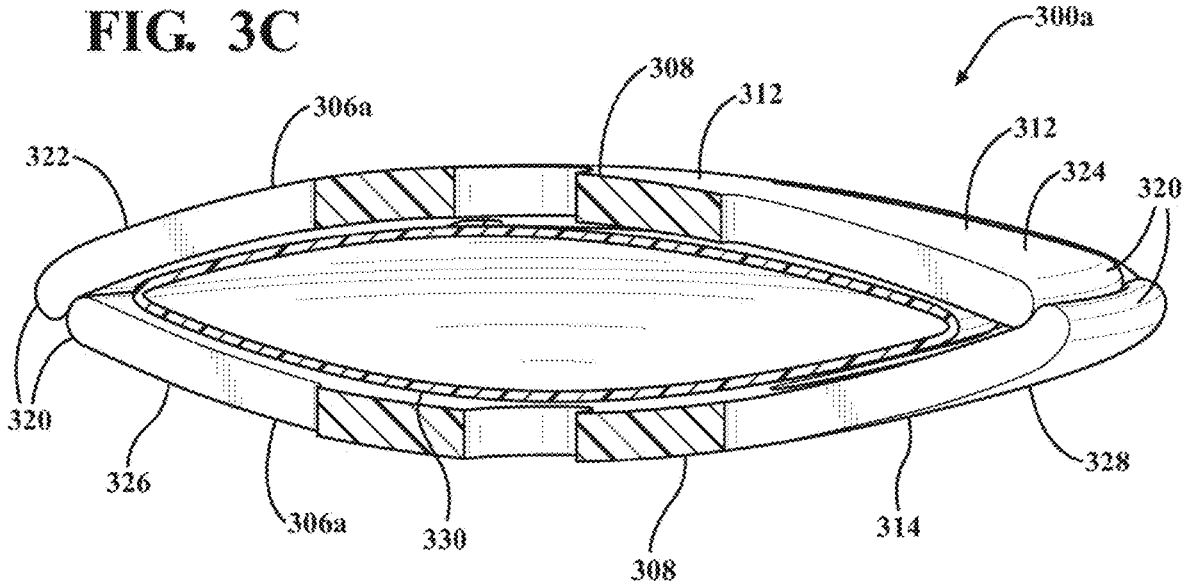
FIG. 3C is a cross-sectional plan view of the pump device of FIG. 3A, taken along line 3C-3C in FIG. 3A.

With particular reference to FIG. 3A-3C, the automatic pump device 300*a* is illustrated with a body 306*a* defining a central flex region 308 and arms 310 radially extending therefrom. The body 306*a* also has first plate 312 and a second plate 314 that interconnect to define a locking arrangement of the body 306*a*. The arms 310 may generally taper from the flex region 308 of each of the first and second plates 312, 314 of the body 306*a*. The arms 310 may have varying lengths, such that a short arm 316 is disposed between two long arms 318. This arrangement may define a nested configuration of the first and second plates 312, 314 to define the body 306*a*. Each of the arms 310 may have curved or otherwise hooked ends 320 configured to interlock with an end 320 of an adjacent arm 310 on the opposing plate 312, 314. The ends 320 alternate in connectivity, such that every other arm 310 of the first plate 312 is nested with every other arm 310 of the second plate 314. Stated differently, the arms 310 of the first and second plates 312, 314 may define an alternating interlocked configuration. By way of example, not limitation, FIG. 3C is illustrated identifying a first arm 322 and a second arm 324 of the first plate 312 and a first arm 326 and a second arm 328 of the second plate to better illustrate the nested configuration. In this example, the first arm 326 of the second plate 314 is received within or otherwise retained by the end 320 of the first arm 322 of the first plate 312, while the second arm 328 of the second plate 314 receives or otherwise retains the second arm 324 of the first plate 312.

The first and second plates 312, 314 are disposed around and generally encase a fluid envelope 330 configured to collect the fluid displaced from the upper 200 (FIG. 1A). The fluid envelope 330 is contemplated to be configured as an airbag, a bladder, and/or any mechanism for holding a volume of fluid (e.g., liquid and/or gas). As described in more detail below, the automatic pump device 300*a* draws an at least partial vacuum within the chambers 204 (FIG. 1B) of the upper 200 by removing fluid from the chambers 204 and transferring the fluid into the fluid envelope 330. The fluid envelope 330 is sealed via a pump valve 332, which may be a check valve and/or any valve for receiving and selectively retaining fluid drawn from the chambers 204 (FIG. 1B).

Figure 4A:
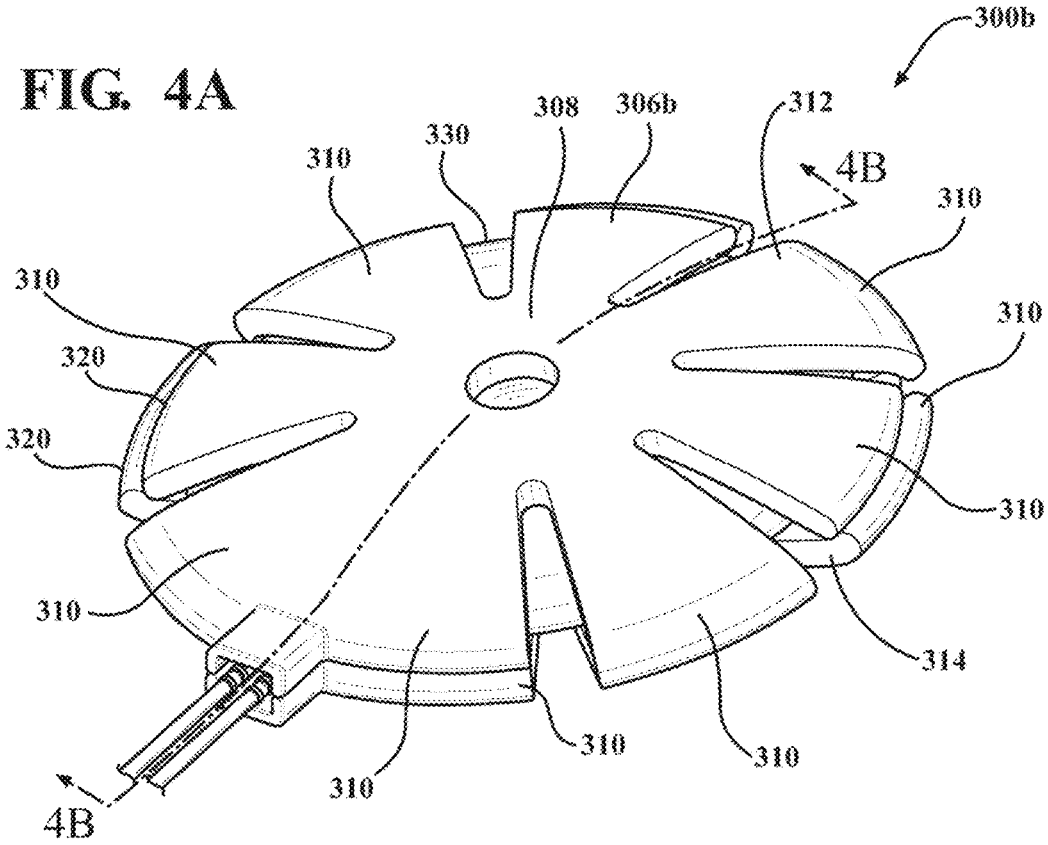
FIG. 4A is perspective view of a pump device according to another example of the present disclosure.
Figure 4B:
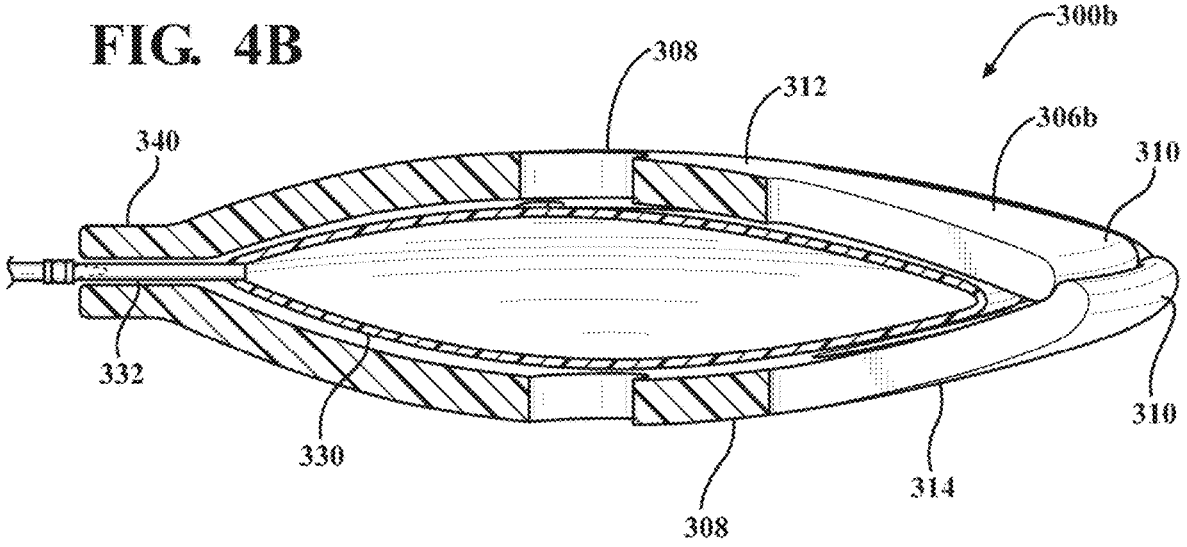
FIG. 4B is a cross-sectional plan view of the pump device of FIG. 4A, taken along line 4B-4B in FIG. 4A.

With reference now to FIGS. 4A and 4B, an automatic pump device 300*b* has a body 306*b* that surrounds or otherwise encases a fluid envelope 330 configured to receive a fluid (e.g., liquid and/or gas) from the upper 200 (FIG. 1A) of the footwear 10 (FIG. 1A). The body 306*b* also includes arms 310 that radially extend from a central flex region 308 at which the automatic pump device 300*b* may be compressed, as will be described in greater detail below. The body 306*b* further includes a bridge 340 coupled to the arms 310 proximate to a pump valve 332. As discussed above, the pump valve 332 may be configured as a check valve. The pump valve 332 may be configured with a spring mechanism typical of a check valve to retain the fluid drawn into the fluid envelope 330. The bridge 340 assists in resisting compression at and around the pump valve 332, such that the pump valve 332 remains open during evacuation of the upper 200 (FIG. 1B).

Figure 5A:
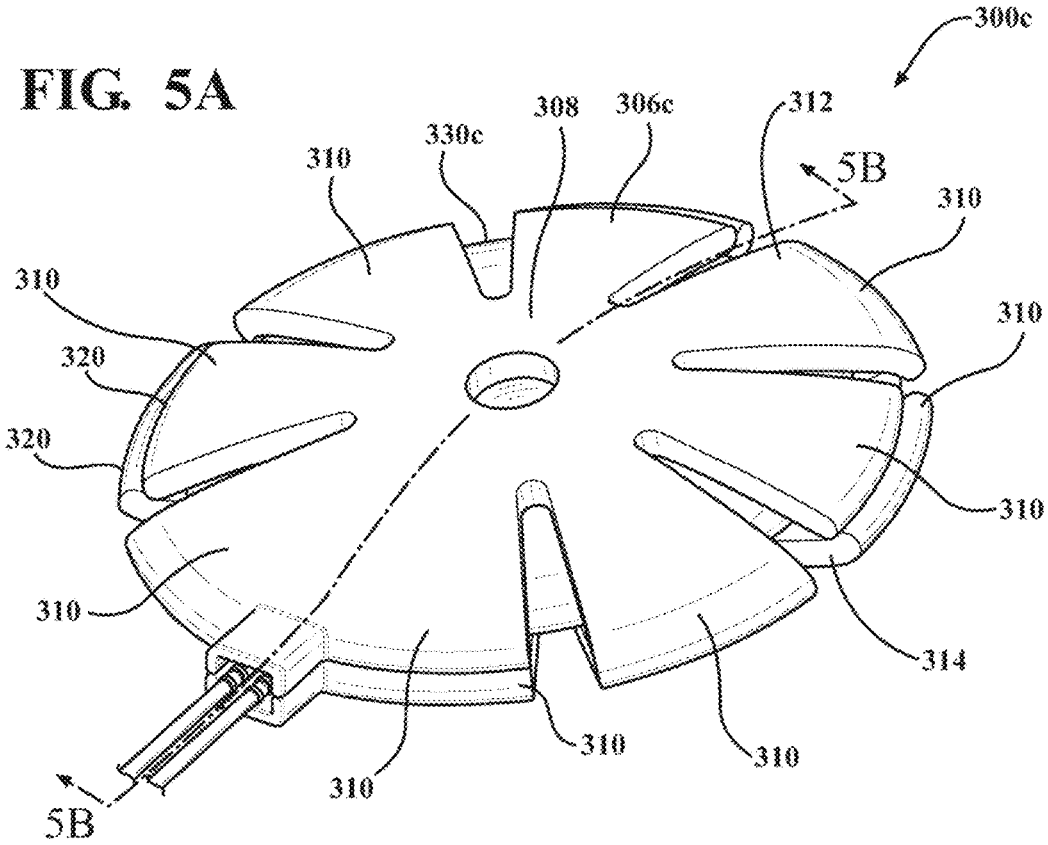
FIG. 5A is a perspective view of a pump device according to another example of the present disclosure.
Figure 5B:
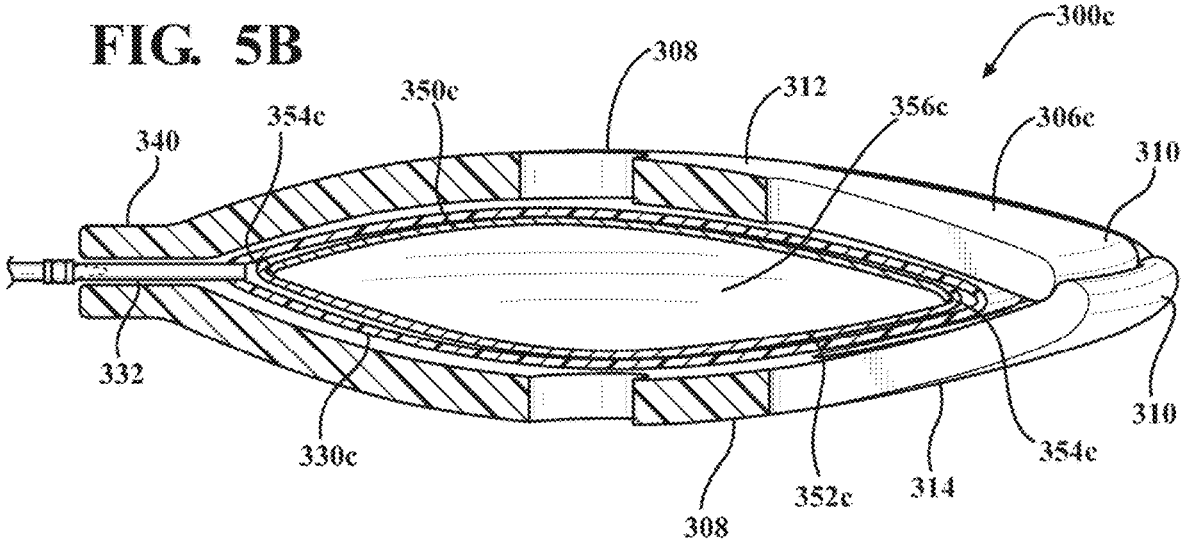
FIG. 5B is a cross-sectional plan view of the pump device of FIG. 5A, taken along line 5B-5B in FIG. 5A.

With reference now to FIGS. 5A and 5B, an automatic pump device 300*c* has a body 306 that surrounds or otherwise encases a fluid envelope 330*c* configured to receive a fluid (e.g., liquid and/or gas) from the upper 200 (FIG. 1A) of the footwear 10 (FIG. 1A). The body 306 also includes arms 310 that radially extend from a central flex region 308 at which the automatic pump device 300*c* may be compressed, as will be described in greater detail below. The body 306 further includes a bridge 340 coupled to the arms 310 proximate to a pump valve 332. As discussed above, the pump valve 332 may be configured as a check valve. The pump valve 332 may be configured with a spring mechanism typical of a check valve to retain the fluid drawn into the fluid envelope 330*c*. The bridge 340 assists in resisting compression at and around the pump valve 332, such that the pump valve 332 remains open during evacuation of the upper 200 (FIG. 1B).

The fluid envelope 330*c* also includes a first plate 350*c* and a second plate 352*c* disposed within the fluid envelope 330*c*. For example, the first and second plates 350*c*, 352*c* are illustrated as conforming to the convex configuration of an interior of the fluid envelope 330*c*. The plates 350*c*, 352*c* include interlocking arms 354*c* similar to the arms 310 of the body 306 of the automatic pump device 300*c*. The interlocking arms 354*c* retain the plates 350*c* 352*c* relative to one another during compression and expansion of the fluid envelope 330*c*. It is also contemplated that the plates 350*c*, 352*c* assist in maintaining a cavity 356*c* of the fluid envelope 330*c* after the fluid is expelled from the cavity 356*c*. For example, when the automatic pump device 300*c* expands, the plates 350*c*, 352*c* within the fluid envelope 330*c* move away from one another due to the shape and resilient material of each plate 350*c*, 352*c*. In so doing, barrier layers of the fluid envelope 330*c* likewise move away from one another, as the layers are attached to the respective plates 350*c*, 352*c* in addition to the plates 312, 314 disposed around the fluid envelope 330*c*. When the plates 350*c*, 352*c* of the fluid envelope 330*c* move away from one another, the effective volume of the fluid envelope 330*c* increases and draws fluid from within the chamber 204 of the upper 200. The fluid is expelled from the fluid envelope 330*c* when the automatic pump 300*c* is compressed, as described in more detail below. Additionally or alternatively, it is contemplated that the fluid may be retained within the fluid envelope 330*c* and selectively redistributed back to the upper 200.

Figure 6A:
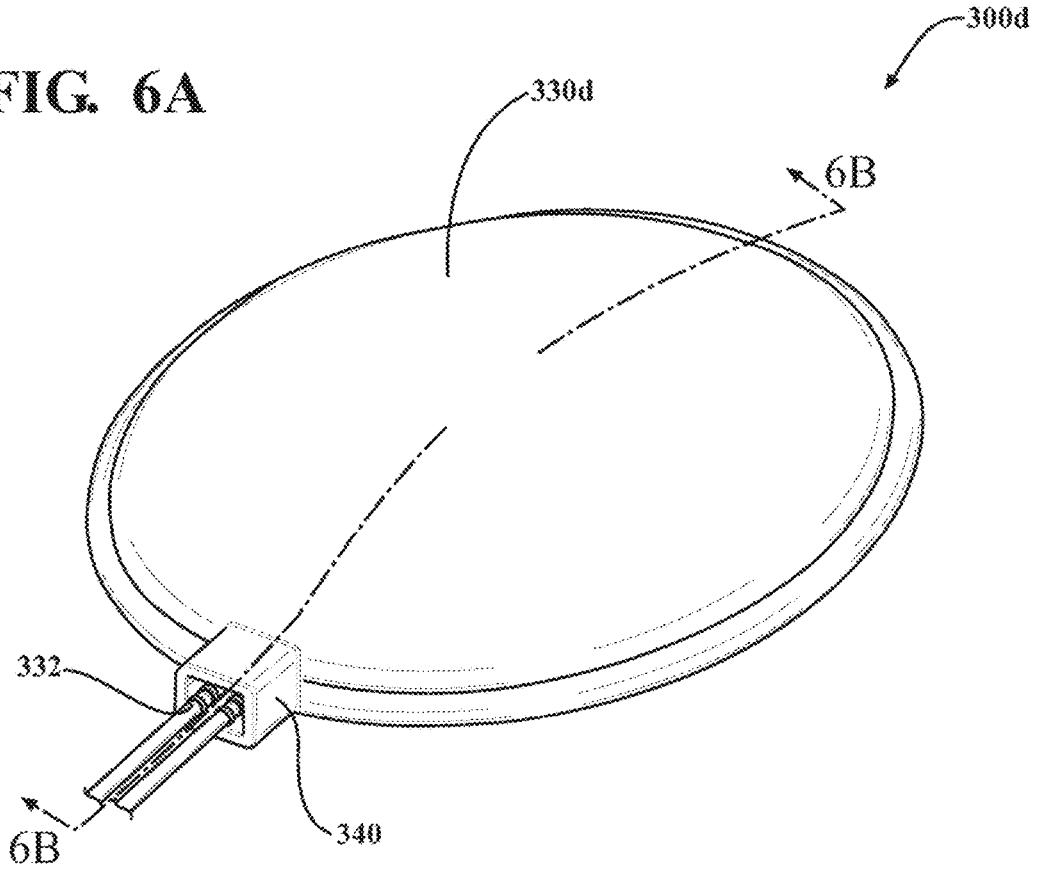
FIG. 6A is a perspective view of a pump device according to another example of the present disclosure.
Figure 6B:
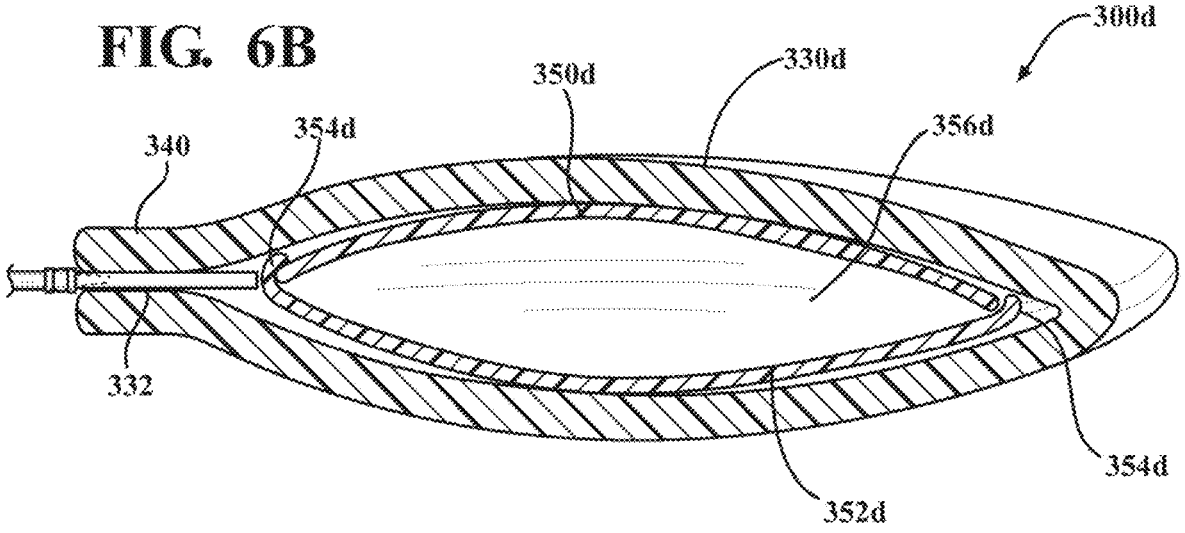
FIG. 6B is a cross-sectional plan view of the pump device of FIG. 6A, taken along line 6B-6B in FIG. 6A.
Figure 7A:
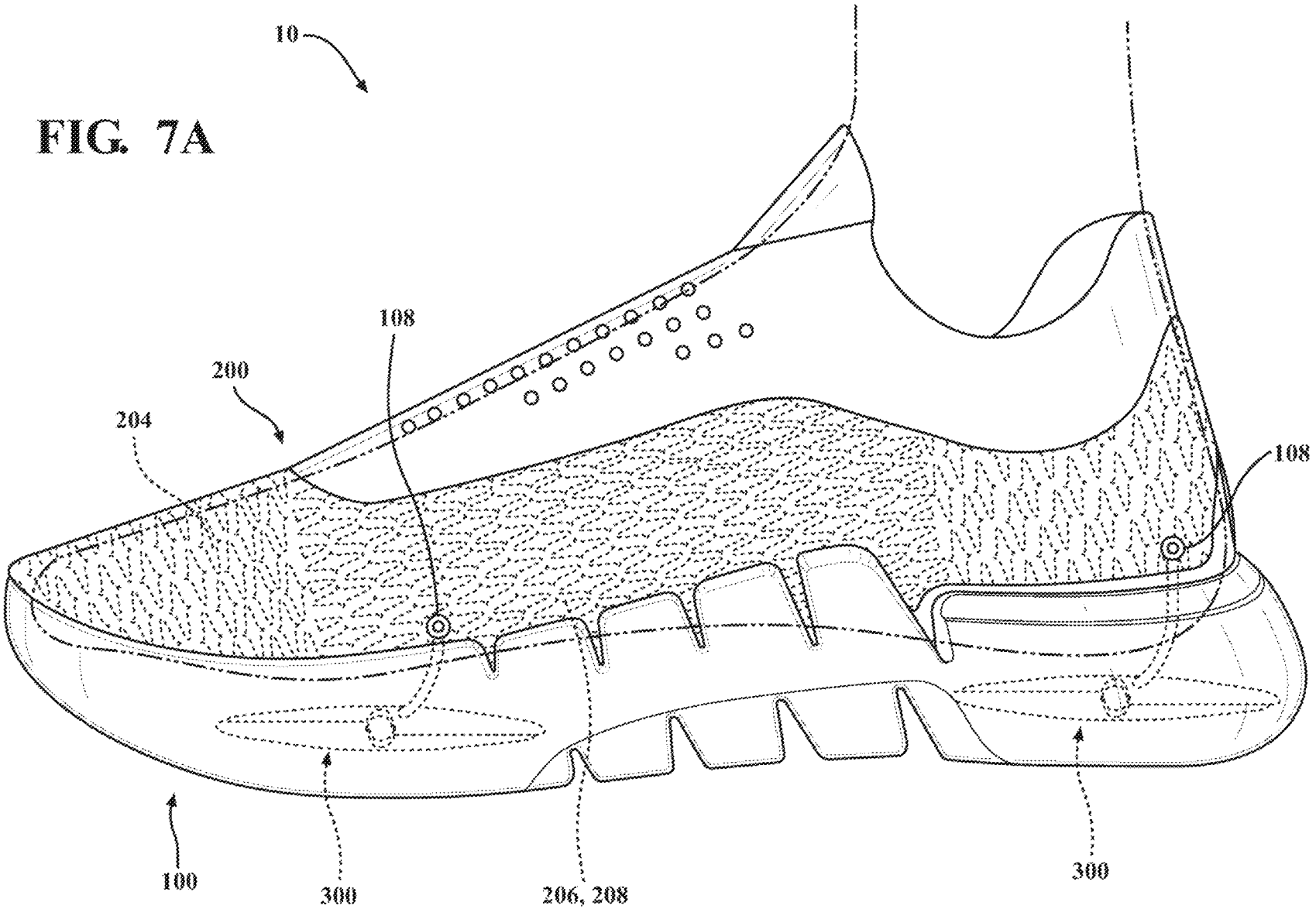
FIG. 7A is a lateral side view of an article of footwear incorporating a pump device according to the present disclosure, where an upper of the article of footwear is in a constricted state.
Figure 7B:
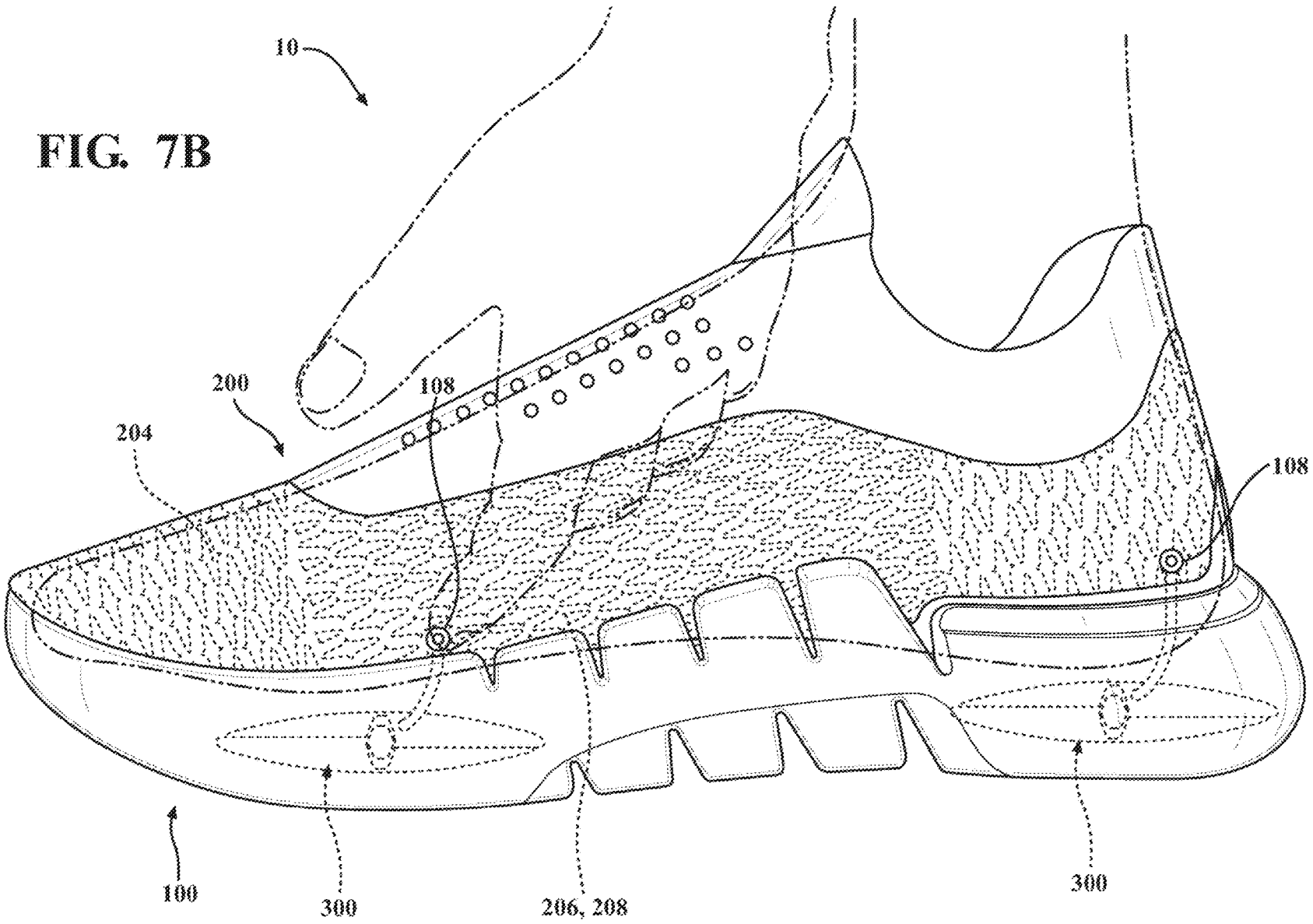
FIG. 7B is a lateral side view of the article of footwear of FIG. 7A, where a wearer is compressing a release feature of the upper.
Figure 7C:
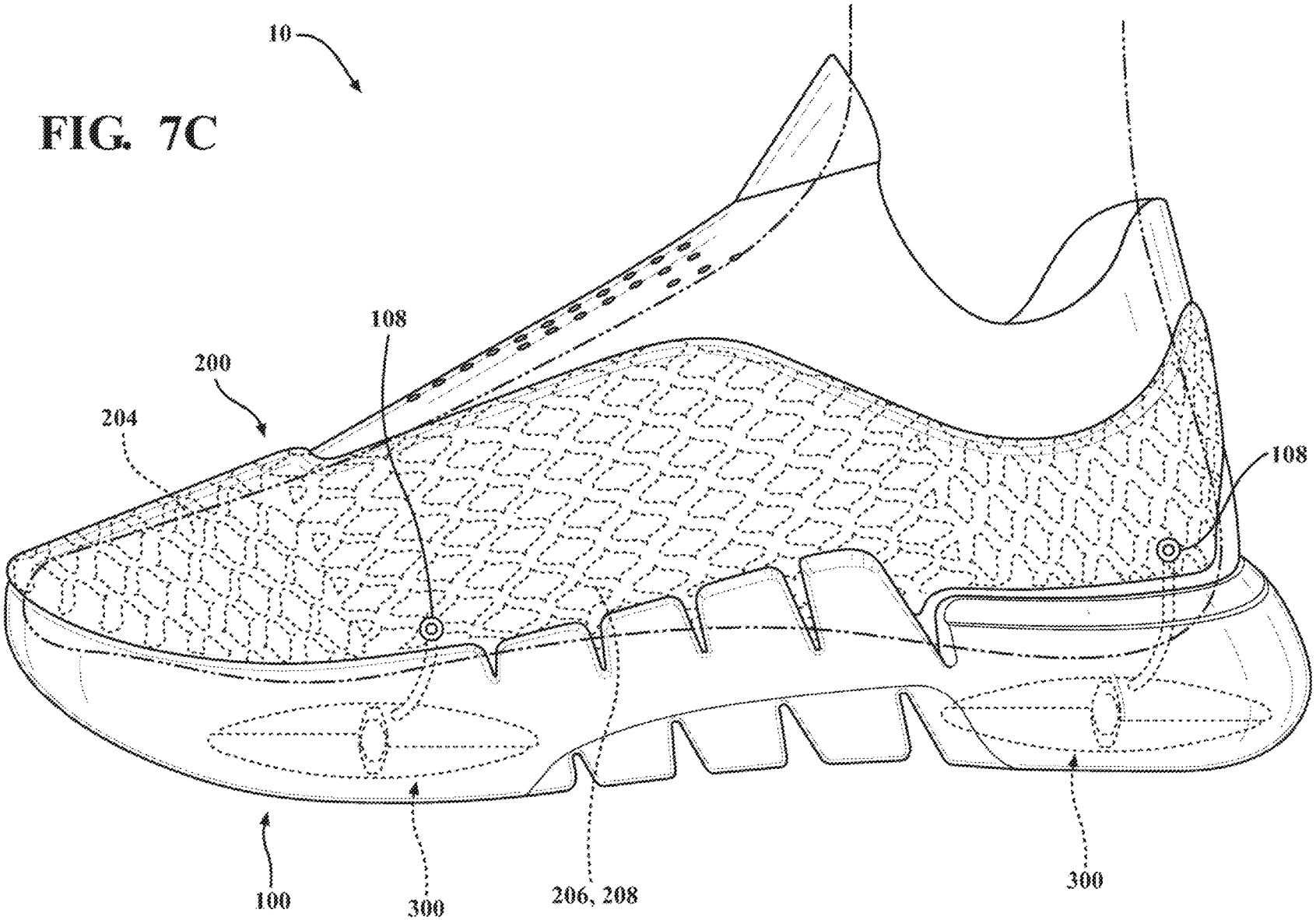
FIG. 7C is a lateral side perspective view of the article of footwear of FIG. 7A, where the upper of the article of footwear is in a relaxed state.

With reference now to FIGS. 6A and 6B, an automatic pump device 300*d* has a fluid envelope 330*d* configured to receive a fluid (e.g., liquid and/or gas) from the upper 200 (FIG. 1A) of the footwear 10 (FIG. 1A). The fluid envelope 330*d* includes a bridge 340 proximate to a pump valve 332 coupled to the fluid envelope 330*d*. As discussed above, the pump valve 332 may be configured as a check valve. The pump valve 332 may be configured with a spring mechanism typical of a check valve to retain the fluid drawn into the fluid envelope 330*d*. The bridge 340 assists in resisting compression at and around the pump valve 332, such that the pump valve 332 remains open during evacuation of the upper 200 (FIG. 1B).

The fluid envelope 330*d* also includes a first plate 350*d* and a second plate 352*d* disposed within the fluid envelope 330*d*. For example, the first and second plates 350*d*, 352*d* are illustrated as conforming to the convex configuration of an interior of the fluid envelope 330*c*. The plates 350*d*, 352*d* include interlocking arms 354*d*. The interlocking arms 354*d* retain the plates 350*d*, 352*d* relative to one another during compression and expansion of the fluid envelope 330*d*. It is also contemplated that the plates 350*d*, 352*d* assist in maintaining a cavity 356*d* of the fluid envelope 330*d* after the fluid is expelled from the cavity 356*d*. For example, when the automatic pump device 300*d* expands, the plates 350*d*, 352*d* within the fluid envelope 330*d* move away from one another due to the shape and resilient material of each plate 350*d*, 352*d*. In so doing, barrier layers of the fluid envelope 330*d* likewise move away from one another, as the layers are attached to the respective plates 350*d*, 352*d*. When the plates 350*d*, 352*d* of the fluid envelope 330*d* move away from one another, the effective volume of the fluid envelope 330*d* increases and draws fluid from within the chamber 204 of the upper 200. The fluid is expelled from the fluid envelope 330*d* when the automatic pump 300*d* is compressed, as described in more detail below. Additionally or alternatively, it is contemplated that the fluid may be retained within the fluid envelope 330*d* and selectively redistributed back to the upper 200.

With reference to FIGS. 3A-7C, the automatic pump device 300 may have a circular configuration, as illustrated. Additionally or alternatively, the automatic pump devices 300*a*, 300*b* may be configured as an oval, an orb, a leaf spring, and/or any other configuration for drawing a vacuum within the upper 200. The first and second plates 312, 314 of the pump device 300 each have a predefined restorative force that returns the flex region 308 to an expanded condition after compression of the pump device 300. For example, the pump device 300 may be compressed at the flex region 308, and the release of the compressed pump device 300 may draw the vacuum by drawing air from the upper 200 (FIG. 7A) into the fluid envelope 330 to define the constricted state of the upper 200 (FIG. 7B), as described in more detail below. Stated differently, the pump device 300 may transition between a first position (FIG. 7C) and a second position (FIG. 7A) as the vacuum is drawn within the upper 200.

Referring now to FIGS. 3A-7C, in use, the pressure within the chambers 204 of the upper 200 is reduced by drawing a vacuum within the chambers 204 of the upper 200 via the automatic pump device 300. As the pressure is reduced, the upper 200 moves from the relaxed state (FIG. 7C) to the constricted state (FIG. 7A) that forms or otherwise draws the upper 200 around the wearer's foot. Thus, as the vacuum is drawn by cycling the automatic pump device 300, as described below with respect to FIGS. 7A-7C, fluid is drawn from within the chambers 204 of the upper 200 and into the fluid envelope 330 of the automatic pump device 300. In so doing, the lattice structure 208 of the compressible component 206 is compressed, thereby constricting the upper 200 around the foot of the wearer. When the release feature 108 is actuated, the lattice structure 208 of the compressible component 206 expands within each chamber 204 due to the shape and resilient nature of the material forming the compressible component 206, thereby causing an internal volume of the chamber 204 to increase. The fluid is typically drawn from the ambient surroundings through the release feature 108. Additionally or alternatively, the increase in volume may draw fluid from the fluid envelope 330 through the pump valve 332 and allows the upper 200 to move to the relaxed state around the wearer of the foot.

With continued reference to FIGS. 3A-7C, the upper 200 may be transitioned between the relaxed state and the constricted state via the automatic pump device 300. For example, a vacuum may be drawn by compressing the automatic pump device 300 during a gait cycle. In other words, when a wearer of the article of footwear 10 takes a step (i.e., a foot strike), the sole structure 100 is compressed. As the sole structure 100 compresses, the automatic pump device 300 is moved from the first position (FIG. 1A) to the second position (FIG. 1C) and draws fluid from the chamber 204 into the fluid envelope 330 of the pump device 300.

When the foot of the wearer of the article of footwear 10 raises (i.e., a foot swing), the sole structure 100 is uncompressed, allowing the automatic pump device 300 to expand from the second position to the first position, creating a vacuum and drawing fluid from the upper 200 into the automatic pump device 300 via the pump valve 332. When the automatic pump device 300 expands, the first and second plates 312, 314 of the pump device 300 move away from one another due to the shape and resilient material of each plate 312, 314. In so doing, barrier layers of the fluid envelope 330 likewise move away from one another, as the layers are attached to the respective plates 312, 314. When the layers of the fluid envelope 330 move away from one another, the effective volume of the fluid envelope 330 increases and draws fluid from within the chamber 204 of the upper 200.

Accordingly, the steps of a gait cycle result in compression of the sole structure 100 followed by decompression of the sole structure 100 and constitute a cycle. For each cycle that the sole structure 100 is compressed, and then decompressed, the pressure within the upper 200 is incrementally reduced. In some examples, the pressure within the upper 200 reaches an ideal pressure to constrict the upper 200 (e.g. −5 psi) after nine (9) steps. In other examples, fewer steps are required. It is contemplated that with each decompression of the sole structure 100, the fluid drawn into the fluid envelope 330 may be expelled to an exterior of the footwear 10. Stated differently, the automatic pump 300 may continually draw a vacuum within the upper 200 by drawing fluid into the fluid envelope 330 and subsequently expelling the drawn fluid from the fluid envelope 330 into the ambient surroundings. Additionally or alternatively, the fluid may be retained within the fluid envelope 330 and returned to the upper 200.

Referring still to FIGS. 3A-7C, when the wearer wishes to move the upper 200 to the relaxed state, the wearer increases the pressure within the chambers 204 of the upper 200 by pressing the release feature 108. For example, FIG. 7B illustrates a wearer compressing the release feature 108 and defining an intermediate state of the compressible component 206 as the upper 200 transitions from the compressed state to the relaxed state. The release feature 108 may be a valve that opens and closes when the wearer respectively applies and removes pressure on the release feature 108. Stated differently, the release feature may be operable to selectively permit a flow of fluid into the chamber 204. For example, the wearer may press the release feature 108 located on the outer surface of the upper 200, which biases the release feature 108 to an open position to allow ambient air to flow into the chambers 204 of the upper 200. Consequently, the pressure within the chambers 204 of the upper 200 is increased, and the upper 200 transitions from the constricted state (FIG. 7A) to the relaxed state (FIG. 7C) around the wearer's foot. The compression of the release feature 108 may also release the pump valve 332, such that any potential fluid retained within the fluid envelope 330 may be released into the chamber 204 of the upper 200 to translate the compressible component 206 of the upper 200 from the compressed state to the relaxed state.

With reference again to FIGS. 1-7C, the automatic pump device 300 advantageously assists in evacuating the chamber 204 of the upper 200 to translate the compressible component 206 from the relaxed state to the compressed state. Optionally, when two pumps 302, 304 are utilized, the pumps 302, 304 may be configured either in series or in parallel. For example, the pump devices 300 illustrated in FIG. 1A are in series with one another. Each configuration may be advantageous, such that there may be an increase in maximum vacuum draw when the pump devices 300 are configured in series. Alternatively, the maximum volume of fluid that the pump devices 300 may hold is increased when the pump devices 300 are configured in parallel. In addition, the interlocking configuration is advantageous in manufacturing the automatic pump device 300. For example, the interlocking configuration of the arms 310 of the first and second plates 312, 314 of the automatic pump device 300 assists in alignment of the first and second plates 312, 314.

The following Clauses provide an exemplary configuration for a sole structure for an article of footwear, an article of footwear, and a composite structure described above.

Clause 1. An article of footwear includes an upper including a chamber, a compressible component disposed within the chamber and operable between a relaxed state and constricted state, a sole structure including a recess forming a cavity, and a pump device disposed within the cavity and fluidly coupled to the chamber, the pump device operable to transition the compressible component from the relaxed state to the constricted state by removing fluid from the chamber.

Clause 2. The article of footwear of Clause 1, wherein the pump device includes a fluid envelope disposed between a first plate and a second plate.

Clause 3. The article of footwear of Clause 2, wherein the pump device includes a valve in fluid communication with the chamber and the fluid envelope.

Clause 4. The article of footwear of Clause 3, wherein the valve is operable to restrict movement of fluid from the fluid envelope to the chamber.

Clause 5. The article of footwear of any of the preceding Clauses, wherein fluid removed from the chamber is received within the fluid envelope.

Clause 6. The article of footwear of any of the preceding Clauses, wherein at least one of the first plate and the second plate is formed from a resilient material.

Clause 7. The article of footwear of any of the preceding Clauses, wherein the first plate and the second plate are biased in a direction away from one another and into an expanded state.

Clause 8. The article of footwear of Clause 7, wherein the first plate and the second plate are moved toward one another when moved from the expanded state to a compressed state.

Clause 9. The article of footwear of Clause 8, wherein fluid is drawn from the chamber and into the fluid envelope when the first plate and the second plate are moved from the compressed state to the expanded state.

Clause 10. The article of footwear of any of the preceding Clauses, further comprising a release operable to selectively allow fluid to enter the chamber and permit movement of the compressible component from the constricted state to the relaxed state.

Clause 11. An article of footwear includes a chamber, a sole structure, and a pump device disposed within the sole structure and including a first plate, a second plate, and a fluid envelope disposed between the first plate and the second plate and fluidly coupled to the chamber, the pump device operable to selectively remove fluid from the chamber when the first plate and the second plate are moved away from one another and into an expanded state.

Clause 12. The article of footwear of Clause 11, wherein the pump device is disposed within the sole structure.

Clause 13. The article of footwear of either of Clause 1 or Clause 2, wherein the pump device includes a valve in fluid communication with the chamber and the fluid envelope.

Clause 14. The article of footwear of Clause 13, wherein the valve is operable to restrict movement of fluid from the fluid envelope to the chamber.

Clause 15. The article of footwear of any of the preceding Clauses, wherein fluid removed from the chamber is received within the fluid envelope.

Clause 16. The article of footwear of any of the preceding Clauses, wherein at least one of the first plate and the second plate is formed from a resilient material.

Clause 17. The article of footwear of any of the preceding Clauses, wherein the first plate and the second plate are biased into the expanded state.

Clause 18. The article of footwear of Clause 17, wherein the first plate and the second plate are moved toward one another when moved from the expanded state to a compressed state.

Clause 19. The article of footwear of any of the preceding Clauses, wherein the fluid envelope is formed from a first barrier element and a second barrier element, the first barrier element being attached to the first plate and the second barrier element being attached to the second plate.

Clause 20. The article of footwear of any of the preceding Clauses, further comprising a release operable to selectively allow fluid to enter the chamber.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper including a chamber;

a compressible component disposed within the chamber and operable between a relaxed state and a constricted state;

a sole structure including a recess forming a cavity; and a pump device disposed within the cavity, fluidly coupled to the chamber, and operable to transition the compressible component from the relaxed state to the constricted state by removing fluid from the chamber, the pump device including a first plate and a second plate each having a central flex region and arms (i) radially extending from the central flex region and (ii) having varying lengths, the first plate and the second plate connecting at ends of the respective arms of the first plate and the second plate.

2. The article of footwear of claim 1, wherein the pump device includes a fluid envelope disposed between the first plate and the second plate.

3. The article of footwear of claim 2, wherein the pump device includes a valve in fluid communication with the chamber and the fluid envelope.

4. The article of footwear of claim 3, wherein the valve is operable to restrict movement of fluid from the fluid envelope to the chamber.

5. The article of footwear of claim 2, wherein fluid removed from the chamber is received within the fluid envelope.

6. The article of footwear of claim 2, wherein at least one of the first plate and the second plate is formed from a resilient material.

7. The article of footwear of claim 2, wherein the first plate and the second plate are biased in a direction away from one another and into an expanded state.

8. The article of footwear of claim 7, wherein the first plate and the second plate are moved toward one another when moved from the expanded state to a compressed state.

9. The article of footwear of claim 8, wherein fluid is drawn from the chamber and into the fluid envelope when the first plate and the second plate are moved from the compressed state to the expanded state.

10. The article of footwear of claim 1, further comprising a release operable to selectively allow fluid to enter the chamber and permit movement of the compressible component from the constricted state to the relaxed state.

11. An article of footwear comprising:

a chamber;

a sole structure; and a pump device disposed within the sole structure, including a first plate, a second plate, and a fluid envelope disposed between the first plate and the second plate and fluidly coupled to the chamber, and operable to selectively remove fluid from the chamber when the first plate and the second plate are moved away from one another and into an expanded state, the first plate and the second plate each having a central flex region and arms (i) radially extending from the central flex region and (ii) having varying lengths, the first plate and the second plate connecting at ends of the respective arms of the first plate and the second plate.

12. The article of footwear of claim 11, wherein the pump device includes a valve in fluid communication with the chamber and the fluid envelope.

13. The article of footwear of claim 12, wherein the valve is operable to restrict movement of fluid from the fluid envelope to the chamber.

14. The article of footwear of claim 11, wherein fluid removed from the chamber is received within the fluid envelope.

15. The article of footwear of claim 11, wherein at least one of the first plate and the second plate is formed from a resilient material.

16. The article of footwear of claim 11, wherein the first plate and the second plate are biased into the expanded state.

17. The article of footwear of claim 16, wherein the first plate and the second plate are moved toward one another when moved from the expanded state to a compressed state.

18. The article of footwear of claim 11, wherein the fluid envelope is formed from a first barrier element and a second barrier element, the first barrier element being attached to the first plate and the second barrier element being attached to the second plate.

19. The article of footwear of claim 11, further comprising a release operable to selectively allow fluid to enter the chamber.

* * * * *